US006497327B1

(12) United States Patent
Rindfleisch

(10) Patent No.: US 6,497,327 B1
(45) Date of Patent: Dec. 24, 2002

(54) GOLF CLUB HOLDER

(76) Inventor: Perry S. Rindfleisch, 1805 White Oak Loop, Round Rock, TX (US) 78681

( * ) Notice: Subject to any disclaimer, the term of this patent is extended or adjusted under 35 U.S.C. 154(b) by 0 days.

(21) Appl. No.: 09/792,361

(22) Filed: Feb. 22, 2001

(51) Int. Cl.[7] ..... A63B 55/04
(52) U.S. Cl. ..... 211/70.2; 248/156; 248/530
(58) Field of Search ..... 211/70.2; 248/156, 248/688, 530, 121; 473/282

(56) References Cited

U.S. PATENT DOCUMENTS

| | | | | | |
|---|---|---|---|---|---|
| 699,391 | A | * | 5/1902 | Johnson | 211/70.2 |
| 3,483,996 | A | * | 12/1969 | Scammon | 294/143 |
| 4,108,439 | A | * | 8/1978 | McGuire | 473/150 |
| D318,090 | S | | 7/1991 | Bahns | |
| 5,127,530 | A | | 7/1992 | Ortuno | |
| 5,152,524 | A | * | 10/1992 | Brown | 473/284 |
| 5,230,507 | A | * | 7/1993 | White et al. | 473/282 |
| 5,285,990 | A | * | 2/1994 | Engel | 248/156 |
| 5,467,980 | A | | 11/1995 | Weisenstein | |
| 5,474,191 | A | * | 12/1995 | Bergeron et al. | 211/70.2 |
| D371,590 | S | | 7/1996 | Ludwig | |
| 5,597,363 | A | | 1/1997 | Leote | |
| 5,636,754 | A | | 6/1997 | Ennis | |
| 5,820,479 | A | | 10/1998 | Cline | |
| 5,868,143 | A | * | 2/1999 | Nielsen | 131/329 |
| 5,873,471 | A | * | 2/1999 | Ruggeri | 211/70.2 |
| D418,186 | S | | 12/1999 | Canterbury | |

* cited by examiner

*Primary Examiner*—Gregory J. Strimbu
(74) *Attorney, Agent, or Firm*—Thompson & Knight, LLP

(57) ABSTRACT

A golf club holder useful for holding selected golf clubs in a generally upright position once such selected golf clubs have been extracted from the golf club bag for use by a golfer on the fairway or green approaching a hole. Such golf club holder includes a pointed shaft for insertion into the ground, a handle for ease in insertion and retraction of the golf club holder from the ground, a cigar holder, a bag hanger, and an international orange colored head assembly for ease in locating the golf club holder.

4 Claims, 2 Drawing Sheets

GOLF CLUB HOLDER

BACKGROUND OF THE INVENTION a. Field of the Invention

The present invention is related generally to the field of golf club holders, devices developed to support a golf club which has been removed from a golf bag in an upright position on the turf of the fairway and/or putting green.

Recreational golfers typically use more than one golf club to take the necessary swings, striking the golf ball as it lies on the fairway and/or green approaching a hole. Typically, the recreational golfer uses a golf cart which cannot be driven upon the green, and typically the recreational golfer does not have the assistance of a caddie. Accordingly, the usual situation confronted by the recreational golfer is that he needs the use of more than one golf club and he must carry all of the clubs himself. This situation results in the golfer extracting his desired drivers, wedges, and putter from the golf bag, and carrying the individual clubs with him for use in taking the necessary swings, striking the golf ball and approaching the hole. The golfer, carrying clubs outside the golf bag, then places unneeded golf clubs on the ground or propped up against a tree or other natural structure while he takes each swing in his approach to the hole.

Accordingly, a substantial problem confronted by the recreational golfer is that the golf clubs not needed for the particular swing being taken are placed on the ground in a prone position, or leaned up against a tree, by the golfer and then often lost and/or forgotten in the heat of competition.

A further problem often encountered by the recreational golfer is that golf clubs placed on the ground in a prone position, or leaned up against a tree, are subject to damage from ground moisture or from an inadvertent step by the golfer or a guest which could crush or bend the shaft of the golf club.

A yet further problem encountered by the golfer is that any device utilized as a golf club holder should provide a handle so that such golf club holder can be easily and affirmatively be pushed into the ground of the green and easily be extracted from the ground of the fairway or green after use. Such golf club holder handle should relieve the necessity for grasping the shaft of the golf club holder in order to insert or remove the golf club holder from the ground.

A yet further problem routinely encountered by golfers is that many of them have the habit of smoking a cigar while taking a leisurely turn about the course, and such cigars have necessarily to be held while the golfer is taking his swing. Again, unless the golfer is accompanied by an accommodating caddie, the golfer is forced to place his cigar on the ground or other available natural support while driving or putting.

A yet further problem encountered by a golfer is that any device utilized as a golf club holder, itself, must be carried from hole to hole as the golfer proceeds over the course. It is desirable that the golf club holder be carried inside the golf bag and that it be constructed of soft material(s) as it might otherwise scratch or wrongfully interact with the heads of the golf clubs being carried in the golf bag.

A yet further and final problem encountered by the golfer is that any device utilized as a golf club holder must be easily locatable. Far too often the golfer, concentrating on the swing to be made, forgets precisely where the golf club holder and the clubs being supported thereby was left.

b. Description of the Prior Art

Golf club holders are well known in the prior art.

Descriptions of such devices can be found in the following described U.S. Patents.

U.S. Pat. Nos. 5,597,363 and 5,820,479 teach golf club holders which are insertable into the ground and which have a plastic structure to support a golf club in an upright position on the turf of a putting green once the golf club has been taken outside of the golf bag.

U.S. Pat. No. D-371,590 teaches a golf club holder which is insertable into the ground and which provides an off-center support hook to support golf clubs in an upright position on the turf of a putting green once the golf club has been taken outside of the golf bag. A feature of this golf club holder is the separate club head support which is inserted into the ground in proximity to the golf club holder to provide additional support to the golf club being supported.

U.S. Pat. No. 5,467,980 teaches a golf club support device which provides a ground engaging assembly and is thus insertable into the ground, and which provides a handle engaging assembly for the golf club handle(s) whereby golf clubs may be supported at a distance above the ground.

U.S. Pat. Nos. 5,636,754, D-418,186 and D-318,090, additionally, teach golf club support devices which may be inserted into the ground and which may serve as golf club support devices to hold the golf club handle(s) above the ground.

However, the cited prior art golf club holders do not provide in combination a handle for insertion and removal of the golf club holder from the ground; a cigar holder; a means for connecting the golf club holder to the golf club bag; and a means for locating the golf club holder on the green. There is, thus, in the art a need for a golf club holder or support device which provides such combination of features.

The above-identified problems found in the prior art are addressed and overcome by the preferred embodiment of the instant invention. Other advantages of the present invention over the prior art also will be rendered evident.

SUMMARY OF THE INVENTION

The instant invention is of a golf club holder or support device which provides a shaft with a pointed end insertable into the ground of a green, a handle for insertion and removal of the golf club holder from the ground; a cigar holder; a means for carrying the golf club holder outside the golf club bag; and a means for locating the golf club holder on the green.

The instant invention was created to fill the void left in the prior art of golf club holders by providing in combination of features and solutions for the numerous problems noted in the prior art devices.

Accordingly, it is an object of this invention to provide a device, a golf club holder or support device, which supports golf clubs which have been removed from the golf bag in an upright position.

It is a further object of the invention to provide a golf club holder which has a pointed end on its shaft for easy insertion into the ground of a fairway or green.

It is a yet further object of the invention to provide a golf club holder which has a handle for ease in insertion and retraction of the golf club holder's shaft from the ground of a fairway or green.

It is a yet further object of the invention to provide a golf club holder which provides a cigar holder.

It is a yet further object of the invention to provide a golf club holder which provides a bag hanger for connection of the golf club holder to the opening or mouth of the golf club bag.

It is a yet further object of the invention to provide a golf club holder which provides a means for locating the golf club holder on the green.

It is yet a further and final object of the invention to provide a golf club holder which satisfies the foregoing objects and provides the indicated features in various useful combinations.

DESCRIPTION OF NUMERIC REFERENCES

1. the instant invention, a golf club holder
3. head assembly
5. handle
7. cigar holder
9. bag hanger
11. shaft
13. pointed end of shaft
15. ground
18. golf club
21. connecting member
25. perpendicular member

BRIEF DESCRIPTION OF THE DRAWINGS

While the novel features of the instant invention are set forth with particularity in the appended claims, a full and complete understanding of the invention can be had by referring to the detailed description of the preferred embodiment(s) which are set forth subsequently, and which are as illustrated in the accompanying drawings, in which:

DESCRIPTION OF THE PREFERRED EMBODIMENTS(S)

Figure 1:
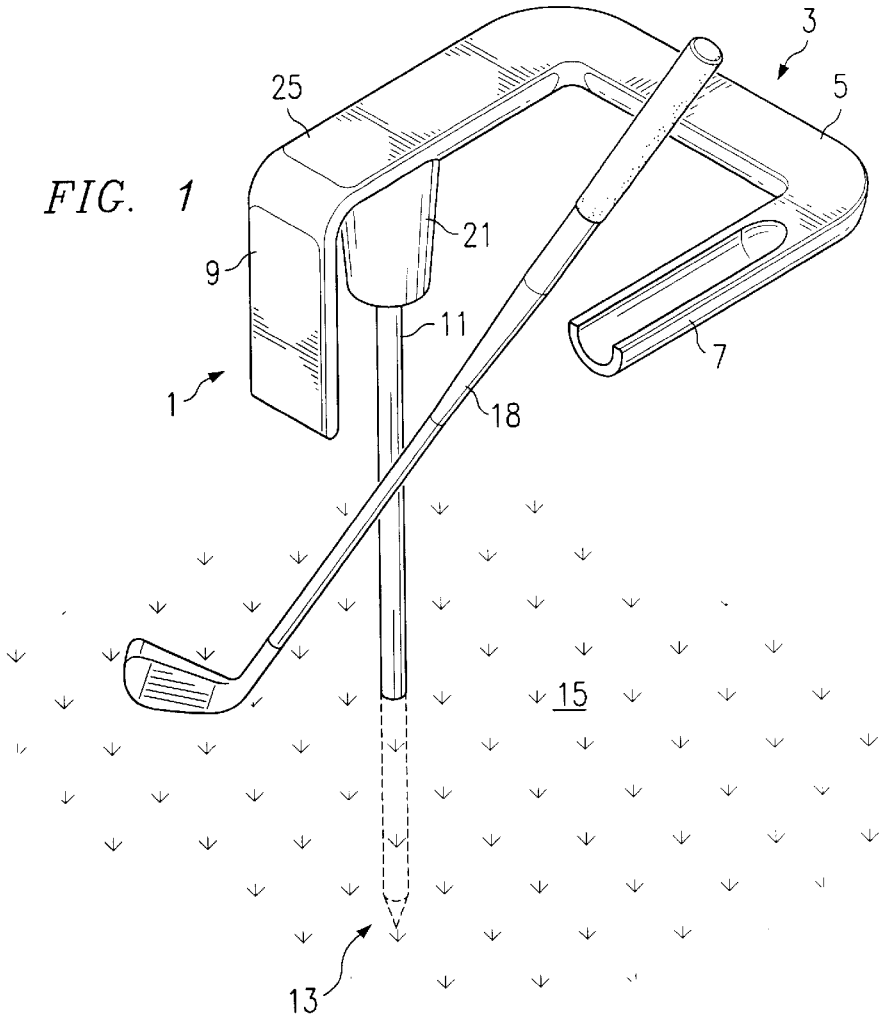
FIG. 1 is a perspective view of the invention inserted into the ground and supporting a golf club.

As seen in FIG. 1, the instant invention is of a golf club holder 1 which is depicted in FIG. 1 in use with the pointed end 13 of the golf club holder's 1 shaft 11 inserted into the ground 15 and with a golf club 18 handle being supported by the head assembly 3 above the ground 15. Accordingly, the instant invention has in common with all other, prior art, golf club holders the advantage that the grips/handles of the golf clubs 18 being supported by the golf club holder 1 are protected by their upright position from becoming moist with dew on the ground 15. In the preferred embodiment of the instant invention, the golf club holder 1 is comprised of a head assembly 3 which is permanently and non-rotationally affixed to a stainless steel shaft 11.

Figure 2:
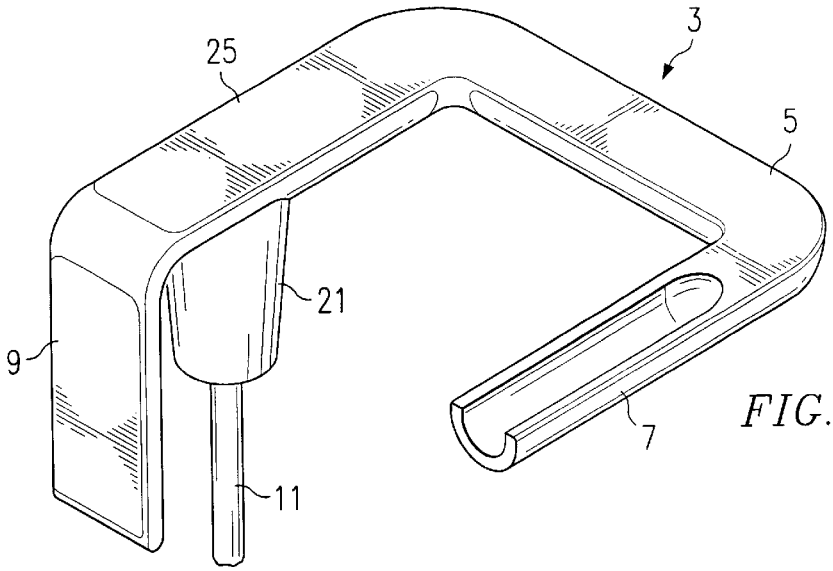
FIG. 2 is a perspective view of the head assembly of the instant invention depicting the international orange coloration.
Figure 3A:
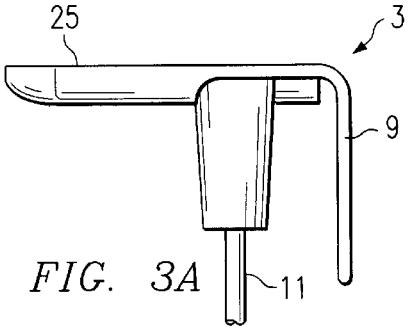
FIG. 3A is a plane view of the head assembly of the instant invention taken along line FIG. 3A—FIG. 3A of FIG. 3.
Figure 3:
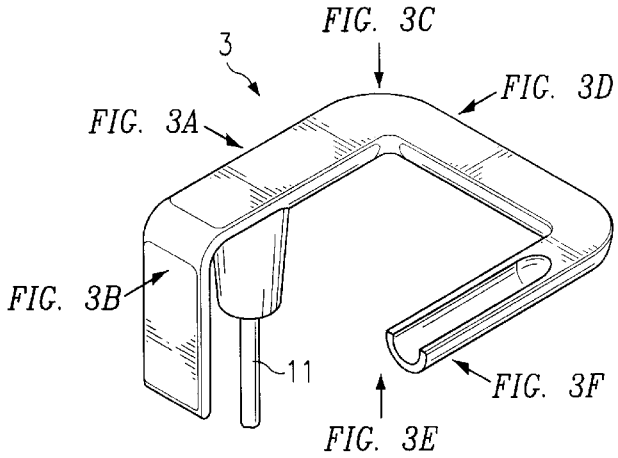
FIG. 3 is a perspective view of the head assembly of the instant invention.
Figure 3B:
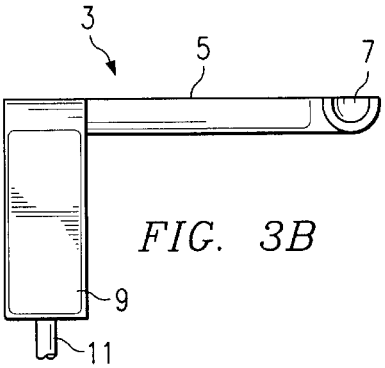
FIG. 3B is a plane view of the head assembly of the instant invention taken along line FIG. 3B—FIG. 3B of FIG. 3.
Figure 3C:
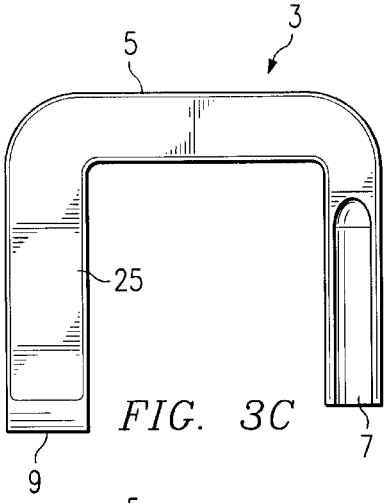
FIG. 3C is a plane view of the head assembly of the instant invention taken along line FIG. 3C—FIG. 3C of FIG. 3.
Figure 3E:
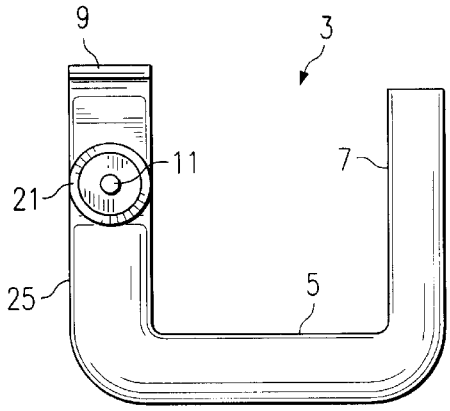
FIG. 3E is a plane view of the head assembly of the instant invention taken along line FIG. 3E—FIG. 3E of FIG. 3.
Figure 3D:
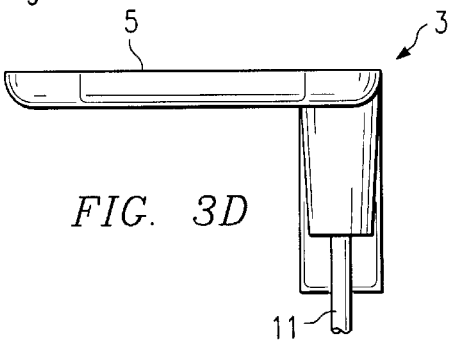
FIG. 3D is a plane view of the head assembly of the instant invention taken along line FIG. 3D—FIG. 3D of FIG. 3.
Figure 3F:
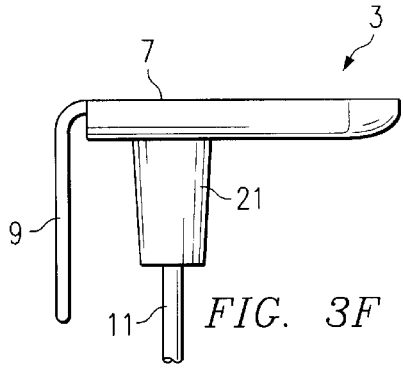
FIG. 3F is a plane view of the head assembly of the instant invention taken along line FIG. 3F—FIG. 3F of FIG. 3.

FIGS. 2 and 3 of the drawings are detailed depictions of the head assembly 3 of the instant invention. The head assembly 3 is constructed of soft molded plastic in a single piece construction. The head assembly's 3 single piece construction of soft molded plastic prevents scratching of the heads of the golf clubs 18 within the golf bag during transport of the golf club holder 1. The head assembly 3 is, in the preferred embodiment, colored international orange as indicated in FIG. 2, in order to provide a readily visible means of locating the golf club holder 1 and those golf clubs 18 which it may be holding for the golfer while the golfer is making his next swing. The international orange coloration of the head assembly 3 acts as a vivid, visual reminder of the presence of the golf club holder 1 and of the golf clubs 18 so that the golfer is less likely to forget them and leave them behind as he proceeds to the next green. The head assembly 3 has integral to its construction a bag hanger 9 which is useful for hanging the golf club holder 1 on the mouth of and within the golf bag for carriage between holes/greens. The bag hanger 9 provided by the head assembly 3 is sturdy, rigid, and reliable, yielding a firm grip on the opening of the golf bag upon which it is hung. Hanging the golf club holder 1 from the lip of the opening of the golf bag provides the advantage of keeping the pointed end 13 of the shaft 11 from poking into, perhaps through, the bottom of the golf bag. In the preferred embodiment, the head assembly 3 is constructed of soft molded plastic in order to avoid causing the golf club holder 1 to interact with and possibly scratch or otherwise damage the heads of those golf clubs 18 within the golf bag. The head assembly 3, additionally in the preferred embodiment, provides a handle 5 as an integral part of the head assembly's 3 construction. The handle 5 provides a firm, reliable, non-rotational grip to easily insert and retract the golf club holder I from the ground 15 of a golf course green. The handle 5 provided by the head assembly 3 is ergonomically designed for easy use and a sure grip on the golf club holder 1 when inserting and extracting the golf club holder 1 from the ground 15. The head assembly 3, further, in the preferred embodiment, provides a cigar holder 7 for the golfer's placement of his cigar while using one of the golf clubs 18. The refinement of a cigar holder 7 is, for a recreational golfer, close to the ultimate in convenience. The head assembly 3 is permanently, non-rotationally, affixed to the shaft 11.

The shaft 11 is constructed of a stainless steel rod with a pointed end 13 for easy insertion into the ground 15 of a golf course green. Use of stainless steel for the shaft 11 of the golf club holder 1 of the instant invention prevents discoloration, corrosion, and easy deformation. The shaft 11 of the golf club holder 1 is in the preferred embodiment circular in cross-section, but variations in the cross-section are permissible within the scope of the invention. The end of the shaft 11 opposite the pointed end 13 is permanently, non-rotationally, affixed to the head assembly 3.

The head assembly 3 is comprised of a connecting member 21, a perpendicular member 25, a bag hanger 9, a handle 5, and a cigar holder 7. The connecting member 21 is that portion of the head assembly 3 which is affixed to the shaft 11. The connecting member 21 is essentially cylindrical in form, provides an aperture at one end, and is affixed to that end of the shaft 11 which is opposite the pointed end 13 of the shaft 11. The connecting member 21 is affixed that end of the shaft 11 which is opposite the pointed end 13 of the shaft 11 whereby the shaft 11 protrudes from the aperture of the connecting member 21. When affixed to the shaft 11, the center axis of the cylindrical shape of the connecting member 21 is concentric to the longitudinal axis of the shaft 11.

In the preferred embodiment, the perpendicular member 25 is a roughly semi-cylindrical shape providing a semicircular shape when viewed from one end. The perpendicular member 25 of the head assembly 3 is that portion of the head assembly 3 that is formed such that the upper, flat, surface of the semi-cylindrical shape of the perpendicular member 25 lies in a plane perpendicular to the center axis of the cylindrical shape of the connecting member 21. The perpendicular member 25 is located at that end of the connecting member 21 opposite the aperture of the connecting member 21 from which the shaft 11 protrudes. The perpendicular member 25 is cantilevered over that end of the connecting member 21 opposite the aperture of the connecting member 21 from which the shaft 11 protrudes.

The bag hanger 9 of the head assembly 3 is, in the preferred embodiment, a roughly 'L' shaped member whose short end is affixed to the short end of the cantilevered perpendicular member 25. Therefore, the bag hanger 9 is seen to have its long end approximately parallel to the longitudinal axis of the shaft 11 when the head assembly 3 is affixed to the shaft 11. The connection of the bag hanger 9 to the perpendicular member 25 is accomplished such that the top side of the short leg of the roughly 'L' shape of the bag hanger 9 is in approximately the same plane as the upper, flat, surface of the semi-cylindrical shape of the perpendicular member 25 and that the long end of the roughly 'L' shape of the bag hanger is pointed in the direction of the pointed end 13 of the shaft 11.

The handle 5 is, in the preferred embodiment, a roughly semi-cylindrical shape providing a semicircular shape when viewed from one end. The handle 5 is connected on one end to the perpendicular member 25 in such fashion that the long, flat surface provided by the semi-cylindrical shape of the handle 5 is in approximately the same plane as the long, flat surface provided by the semi-cylindrical shape of the perpendicular member 25. The handle 5 is connected to the perpendicular member 25 in such fashion that the longitudinal axis of the handle 5 is perpendicular to the longitudinal axis of the perpendicular member 25. The length of the handle 5 is, in the preferred embodiment, on the order of five inches and such as will comfortably accommodate a hand when grasped in a palm-down fashion.

The handle 5 is connected on its end opposite the connection to the perpendicular member 25 to the cigar holder 7 provided by the head assembly 3. The cigar holder 7 provided by the head assembly 3 of the preferred embodiment is semi-cylindrical in shape The upper surface of the cigar holder 7 is indented at one end to accommodate the placement and holding of a cigar on the upper surface of the cigar holder 7. The end of the cigar holder 7 opposite the indentation is connected to the handle 5.

In the preferred embodiment, the cigar holder 7 is connected to the handle 5 in such fashion that the long, flat surface provided by the semi-cylindrical shape of the handle 5 is in approximately the same plane as the upper surface provided by the semi-cylindrical shape of the cigar holder 7. The cigar holder 7 is connected to the handle 5 in such fashion that the longitudinal axis of the cigar holder 7 is perpendicular to the longitudinal axis of the handle 5.

The head assembly 3 of the preferred embodiment, as above-described, thus provides an approximately flat upper surface, formed by the connection of its members: the perpendicular member 25, the handle 5 and the cigar holder 7. The head assembly 3 also provides a parallel spatial relationship between the perpendicular member 25 and the cigar holder 7, and a perpendicular spatial relationship between the handle 5 and each of the perpendicular member 25, the cigar holder 7 and the center axis of the connecting member 25. Additionally, it is seen that the plane in which the perpendicular member 25, the handle 5, and the cigar holder 7 lie is perpendicular to the concentric axes of the connecting member 21 and the shaft 11 when the head assembly 3 is affixed thereto.

In use, the preferred embodiment of the golf club holder 1 of the instant invention normally is carried by hanging the golf club holder 1 by the bag hanger 9 portion of the head assembly 3 on the inside of the golf bag which is carried in the typical recreational golfer's golf cart. When the golfer has driven the golf cart to a point close to the lie (presumed to be on the green, or very close thereto) of the golfer's tee drive, the golfer selects the golf clubs he intends to use in his approach to the hole and then the golfer lifts the golf club holder 1 out of the golf bag and carries the golf club holder 1 and his selected golf clubs 18 to a point near the golf ball. Upon approaching the golf ball, the golfer will grasp the golf club holder 1 by its handle 5 and insert the pointed end 13 of the shaft 11 of the golf club holder 1 into the ground 15 of the green of the golf course. Once the pointed end 13 is inserted into the ground, the golfer then places the club heads of the golf clubs 18 that he has carried from the golf cart on the ground 15 and leans the handles of those same golf clubs 18 against the head assembly 3 of the golf club holder 1, thereby supporting the golf club 18 handles in an upright position above ground 15. Clearly, use of the golf club holder will minimize the muscular strain on the golfer by reducing the necessity to bend in order to pick up golf clubs 18 laid on the ground 15. The golf club holder 1 is, itself, light weight and compact for easy storage within the golf bag between rounds and for easy carrying when it is being deployed for use on the green.

Additionally, and in the event that the golfer is smoking a cigar, the golfer can place his cigar on the cigar holder 7 portion of the head assembly 3 while he makes his swing with his chosen iron or putter.

Once the golfer has completed his necessary swings, striking the golf ball with as many strokes and with as many of the golf clubs 18 as is necessary to get the golf ball into the hole, the golfer then again grasps the handle portion 5 of the head assembly 3 of the golf club holder 1 with his hand and pulls, extracting the golf club holder 1 from the ground 15. Having extracted the golf club holder 1 from the ground 15, the golfer then hangs the golf club holder 1 by its bag hanger 9 onto the mouth of the golf bag whereby the golf club holder 1 hangs inside the golf bag but is carried along with the golf bag to the time of the golf club holder's 1 next use.

While the preferred embodiment(s) of the instant invention have been described in substantial detail and fully and completely hereinabove, it will be apparent to one skilled in the art that numerous variations of the instant invention may be made without departing from the spirit and scope of the instant invention, and accordingly the instant invention is to be limited only by the following claims.

I claim:

1. A golf club holder, useful for holding selected golf clubs in a generally upright position above a golf course green, which comprises:

a shaft, and a head assembly, wherein said shaft includes a first end and a second end, said first end is pointed for insertion into the ground of said course green, said second end is non-rotationally affixed to said head assembly, said head assembly includes a connecting member, a perpendicular member, a bag hanger, and a handle, and said head assembly includes a means for locating said golf club holder when said golf club holder is in use on said course green;

wherein said perpendicular member is connected to said connecting member, said handle is directly connected to a distal end of said perpendicular member disposed from said shaft, and said bag hanger is connected to said perpendicular member;

said shaft defines a first longitudinal axis, said perpendicular member defines a second longitudinal axis, and said handle defines a third longitudinal axis;

wherein said first longitudinal axis is perpendicular to said second longitudinal axis, said second longitudinal axis is perpendicular to said third longitudinal axis, and said second and third longitudinal axes lie in a plane perpendicular to said first longitudinal axis.

2. The golf club holder of claim 1, wherein said head assembly is constructed of molded plastic.

3. The golf club holder of claim 2, wherein said means for locating said golf club holder comprises international orange color.

4. The golf club holder of claim 1 wherein said shaft is constructed of stainless steel.

* * * * *